US007223031B2

(12) United States Patent
Countryman et al.

(10) Patent No.: US 7,223,031 B2
(45) Date of Patent: May 29, 2007

(54) PRINT RIBBON PANEL COLOR IDENTIFICATION

(75) Inventors: Gary P. Countryman, Columbia Heights, MN (US); Gary M. Klinefelter, Eden Prairie, MN (US); Matthew K. Dunham, Eagan, MN (US); James R. Meier, St. Paul, MN (US); Ryan G. Park, Burnsville, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 213 days.

(21) Appl. No.: 10/937,092

(22) Filed: Sep. 9, 2004

(65) Prior Publication Data

US 2005/0063756 A1 Mar. 24, 2005

Related U.S. Application Data

(60) Provisional application No. 60/502,836, filed on Sep. 12, 2003.

(51) Int. Cl.
*B41J 35/16* (2006.01)

(52) U.S. Cl. ..... 400/120.04; 400/120.02; 400/240; 347/177; 347/178

(58) Field of Classification Search ..... 400/120.02, 400/120.03, 120.04, 240; 347/177, 178
See application file for complete search history.

(56) References Cited

U.S. PATENT DOCUMENTS

RE33,260 E 7/1990 Stephenson
5,247,314 A * 9/1993 Stephenson ..... 347/173
5,259,680 A * 11/1993 Shimizu et al. ..... 400/237
5,466,075 A * 11/1995 Kouzai et al. ..... 400/240.3
5,751,601 A * 5/1998 Tang et al. ..... 702/104
6,071,024 A 6/2000 Chi-Ming et al.
6,396,526 B1 5/2002 Sung et al.
6,504,561 B1 1/2003 Yih
6,509,919 B1 1/2003 Tehranchi et al.
6,509,920 B2 1/2003 Sung et al.
6,618,067 B2 9/2003 Yung
2005/0199778 A1* 9/2005 Kadowaki et al. ..... 250/201.5

OTHER PUBLICATIONS

"What Wavelength Goes With a Color" by The Atmospheric Science Data Center; http://eosweb.larc.nasa.gov/EDDOCS/Wavelengths_for _Colors.html, pp. 1-3.*

* cited by examiner

*Primary Examiner*—Daniel J. Colilla
*Assistant Examiner*—Kevin D. Williams
(74) *Attorney, Agent, or Firm*—Westman, Champlin & Kelly, P.A.

(57) ABSTRACT

A ribbon sensor includes a first and second emitter and a receiver. The first emitter is configured to transmit a yellow light signal and the second emitter is configured to transmit a blue light signal. The receiver is configured to produce an output signal in response to the transmission of the yellow and blue light signals through a panel of a print ribbon, wherein the output signal is indicative of a color of the panel. Additional aspects of the present invention are directed to a printer that includes the above-described sensor and a method of using the sensor to identify colored ribbon panels.

20 Claims, 4 Drawing Sheets

PRINT RIBBON PANEL COLOR IDENTIFICATION

The present application is based on and claims the benefit of U.S. Provisional Patent Application Ser. No. 60/502,836, filed Sep. 12, 2003, the content of which is hereby incorporated by reference in its entirety.

BACKGROUND OF THE INVENTION

Identification card printers commonly utilize thermal printheads and thermal print ribbon to transfer dye from the ribbon to the card substrate to form an image thereon. The print ribbon includes different color frames or panels along its length. The frames or panels repeat in a sequence or group consisting of a yellow panel, followed by a magenta panel, which is followed by a cyan panel. In addition, black resin and overlay panels can be provided in the sequence of the color panels, if desired.

Ribbon sensors are used to detect the various panels of the print ribbon. Ribbon sensors typically include an emitter and a receiver that are positioned on opposite sides of the ribbon. The light received by the receiver is analyzed to determine the color of the panel being sensed by the sensor.

Prior art ribbon sensors typically utilize emitters that include a single yellow light emitting diode (LED) to detect the color panels. The yellow LED produces light having a wavelength of approximately 587 nanometers. The receiver, in the form of a photodetector, has a broad visible light wavelength response. When the yellow light passes through the color dye panels it is partially blocked depending on the light wavelength blocking characteristics of the dye of the panel. For example, the cyan panel blocks more of the yellow light than the magenta panel, which blocks more of the yellow light than the yellow panel.

The output signal from the receiver varies in accordance with the light received through the panels. Accordingly, the light received by the receiver through each panel results in a different output signal. This variance in the output signal is used to determine the color of the panel being sensed by the sensor.

Unfortunately, the differences in the output signals for the passage of yellow light through some types of cyan and magenta panels can be very small, making it difficult to distinguish those panels from each other. This problem is exacerbated by the slightly different wavelength blocking characteristics of panels of print ribbons from different vendors.

SUMMARY OF THE INVENTION

The present invention generally relates to a sensor of a printer for identifying color panels of a print ribbon. In accordance with one embodiment of the invention, the sensor includes first and second emitters and a receiver. The first emitter is configured to transmit a yellow light signal and the second emitter is configured to transmit a blue light signal. The receiver is configured to produce an output signal in response to the reception of the yellow and blue light signals through a panel of a print ribbon, wherein the output signal is indicative of a color of the panel. Additional aspects of the present invention are directed to a printer that includes the above-described sensor.

Another aspect of the present invention is directed to a method of identifying panel colors of a print ribbon. In the method, a ribbon sensor is provided that includes a first emitter configured to transmit a yellow light signal, a second emitter configured to transmit a blue light signal, and a receiver. Next, the yellow and blue light signals are transmitted with the first and second emitters. The transmissions of the first and second light signals through a panel of the ribbon are then detected with the receiver. Finally, an output signal is produced by the receiver that is indicative of a color of the panel in response to the detection of the first and second light signals.

Other features and benefits that characterize embodiments of the present invention will be apparent upon reading the following detailed description and review of the associated drawings.

DETAILED DESCRIPTION OF THE PREFERRED EMBODIMENTS

Figure 1:
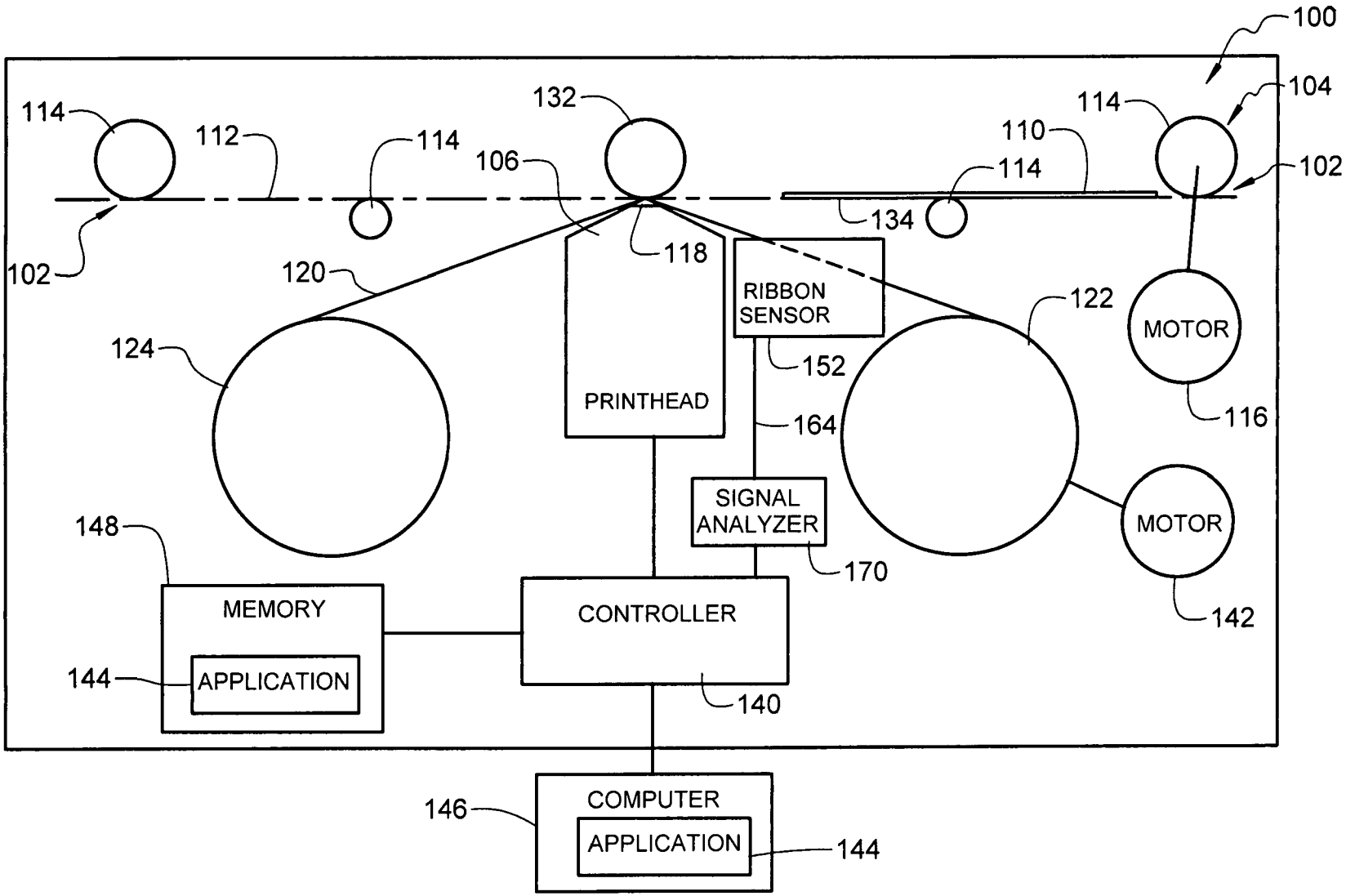
FIG. 1 is a block diagram of an identification card printer in accordance with embodiments of the invention.

FIG. 1 is a schematic diagram of an exemplary identification card printer 100 with which embodiments of the present invention are useful. In general, printer 100 includes a card input 102, a card transport 104, a printhead 106, and a card output 108. Cards 110 are received by the card transport 104 at the card input 102. The card transport 104 feeds cards 110 individually along a print path 112. The print path 112 is preferably substantially flat between card input 102 and card output 108 to avoid substantially bending the rigid or semi-rigid card substrates 110.

The card transport 104 includes card feed rollers 114 that are driven by a motor 116 through, for example, conventional gear and pulley arrangements. It should be understood that separate motors can be used in different stages of card delivery through the printer 100. For example, one motor 116 can be used to drive the feeding of the card 110 through the input 102, and another motor 116 can be used to drive the feeding of the card 110 thereafter through the printer 100. The card feed rollers 114 drive the card 110 along the print path 112. Card support plates or rails (not shown) can also be used to provide support to the card 110 during transport along the print path 112 by the card transport 104.

Printhead 106 is positioned adjacent print path 112 and includes a plurality of resistive heating print elements 118. Although the printhead 106 is illustrated as being oriented such that the print elements 118 face upward, the printhead 106 can also be mounted in a more traditional manner in which the print elements 118 face downward.

In the exemplary identification card printer of FIG. 1, a supply of thermal print ribbon 120 extends between a supply spool 122 and a take-up spool 124, and over the print elements 118. The supply and take-up spools 122 and 124 are preferably positioned adjacent opposite sides of the printhead 106. Print ribbon 120 can be contained in a removable ribbon cartridge.

During a printing operation, the card 110 is fed by the card transport 104 between the print ribbon 120 and a platen 132. Pressure is applied to the print ribbon 120 and a print surface 134 of the card 110 by the platen 132 and the printhead 106. The print elements 118 are selectively energized to heat portions of the print ribbon 120 in contact therewith to cause print material or dye from one or more panels of the print ribbon 120 to transfer to the surface 134 of card 110 to form the desired image thereon. The printed card 110 can then be discharged through the card output 108.

Printer 100 includes a controller 140 that is configured to control the operations of the printer 100 including one or more motors 116 driving the card feed rollers 114 of the card transport 104, one or more motors 142 controlling feeding of the print ribbon 120 between the supply and take-up spools 122 and 124, the selective energization of the print elements 118 of the printhead 106, and other components of printer 100, in response to a print job provided by a card producing application 144.

It should be understood that motors 116 and 142 provide a simplified illustration of the means by which the card transport 104 and supply and take-up rolls 122 and 124 are driven. Fewer or additional motors can be used as desired. Additionally, the motors 116 and 142 can operate to drive additional components than those depicted in FIG. 1. For example, the motor 142 can be configured to drive take-up roll 124 rather than supply roll 122, or both.

The card producing application 144 can run on a computer 146, or be contained in printer memory 148 for execution by controller 140. The print job typically includes card processing instructions, such as print instructions, data writing instructions, data reading instructions, and other card processing instructions in accordance with normal methods.

Figure 2:
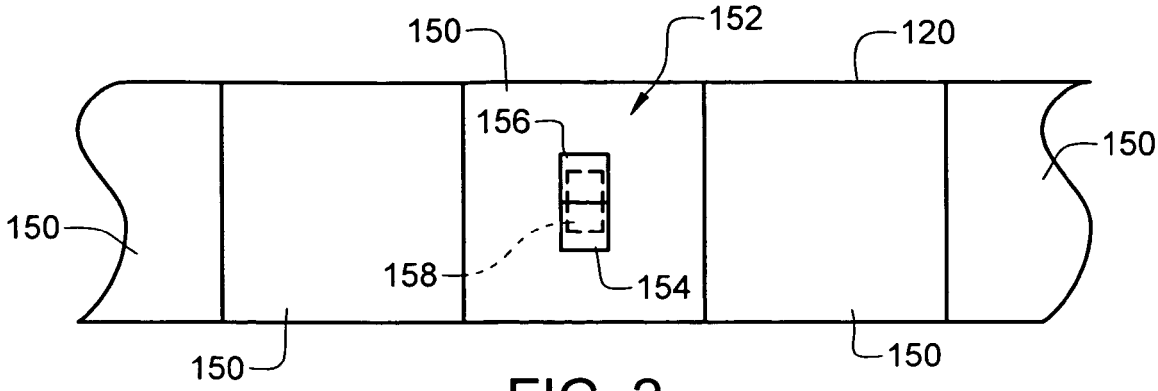
FIG. 2 is a top plan view of a print ribbon and ribbon sensor in accordance with embodiments of the invention.

Thermal print ribbon 120 includes multiple color frames or panels 150 along its length as shown in FIG. 2. The frames or panels typically repeat in a sequence or group consisting of a yellow panel, followed by a magenta panel, which is followed by a cyan panel. In addition, a black resin frame or panel can be provided in sequence of the color panels, if desired.

The printhead 106 selectively prints image lines to the surface 134 of card 110 from the panels of the ribbon 120 to form images thereon under the control of the controller 140. Colored images are formed by transferring the dye from the different color panels to the surface 134 in an overlapping fashion. This process is made possible, in part, by ribbon sensor 152 of the present invention.

In general, ribbon sensor 152 is positioned adjacent print ribbon 120 and is configured to identify the different colored ribbon panels 150. The controller 140 uses the information produced by the sensor 152 to align the desired colored dye panel with the print elements 118 of the printhead 106 to print a colored image.

Figure 3:
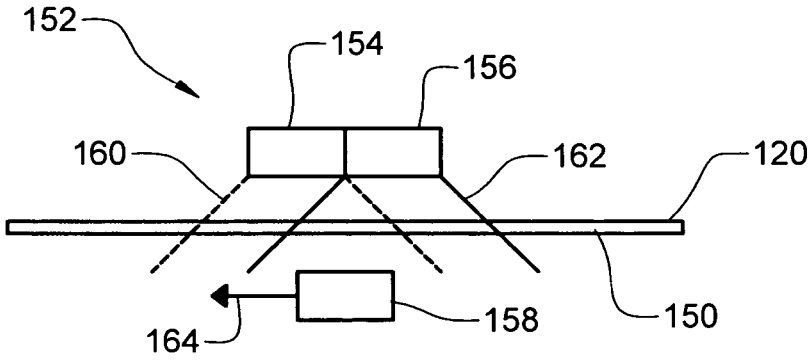
FIG. 3 is a front plan view of a print ribbon and a ribbon sensor in accordance with embodiments of the invention.
Figure 4:
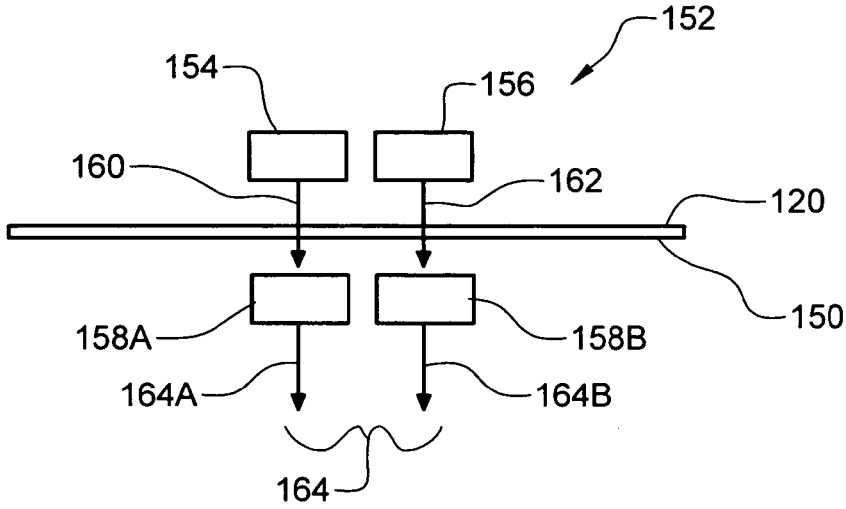
FIG. 4 is a front plan view of a print ribbon and a ribbon sensor in accordance with embodiments of the invention.

FIG. 2 is a simplified top view of the sensor 152 adjacent ribbon 120 and FIGS. 3 and 4 are simplified front views of sensor 152 adjacent print ribbon 120, in accordance with embodiments of the invention. Sensor 152 generally includes dual emitters 154 and 156 and either one receiver 158 (FIG. 3) configured to detect the light signals transmitted through the ribbon 120 by both emitters 154 and 156, or dual receivers 158A and 158B (FIG. 4) wherein receiver 158A is configured to detect the light signal 160 from emitter 154 and receiver 158B is configured to detect the light signal 162 from emitter 156.

In accordance with one embodiment of the invention, the emitters 154 and 156 adjoin each other, as shown in FIGS. 2 and 3. The receivers are positioned on a side of the ribbon 120 that is opposite the side on which the emitters 154 and 156 are located in order to detect the light signals 160 and 162 transmitted by the emitters through the ribbon. For the single receiver configuration, the receiver 158 is preferably positioned immediately below the emitters 160 and 162. For the dual receiver configuration, each receiver 158A and 158B is preferably positioned below the corresponding emitter 154 and 156, respectively.

Emitters 154 and 156 are configured to transmit the light signals 160 and 162 having different wavelengths, or at least where each light signal has a primary energy level (i.e., peak intensity level) that is at a different wavelength than the other. The selection of the wavelengths of the light transmitted by the emitters is based upon the transmissivity of colored ribbon panels 150, which are different for each color. The light transmitted by emitters 154 and 156 pass through print ribbon 120 and are received by receiver 158, which produces an output signal 164 in response thereto. The object is to make use of the different transmissivities such that a difference in the light that is received by the one or more receivers 158 can be detected and thereby used to identify the colored panels 150.

In accordance with one embodiment of the invention, the light signal 160 transmitted by the emitter 154 has a wavelength of greater than 500 nanometers (nm). Preferably, emitter 154 includes a yellow LED that is configured to transmit the light signal 160 as a yellow light signal having a wavelength of approximately 587 nm. The light signal 162 produced by emitter 156 preferably has a wavelength of less than 500 nm. In accordance with one embodiment of the invention, the emitter 156 includes a blue LED that is configured to transmit the light signal 162 as a blue light signal having a wavelength of approximately 468 nm.

The use of both the yellow and blue light signals allows the ribbon sensor 152 of the present invention to provide a relatively wide distribution of output signals 164 that are indicative of the yellow, magenta and cyan ribbon panels 150 as compared to ribbon sensors of the prior art that utilize only yellow light signals. This improvement allows for more accurate ribbon panel color identification.

The one or more receivers 158 can include photodetectors, such as a Sharp photodarlington detector, or other suitable detector. Each are configured to produce the output signal 164 in response to the detection of the light signals 160 and 162 transmitted through the ribbon 120 by emitters 154 and 156. The output signal 164, or a combination of the output signals 164A and 164B (FIG. 4), is indicative of the intensity of the light that is transmitted through the subject panel 150.

Figure 5:
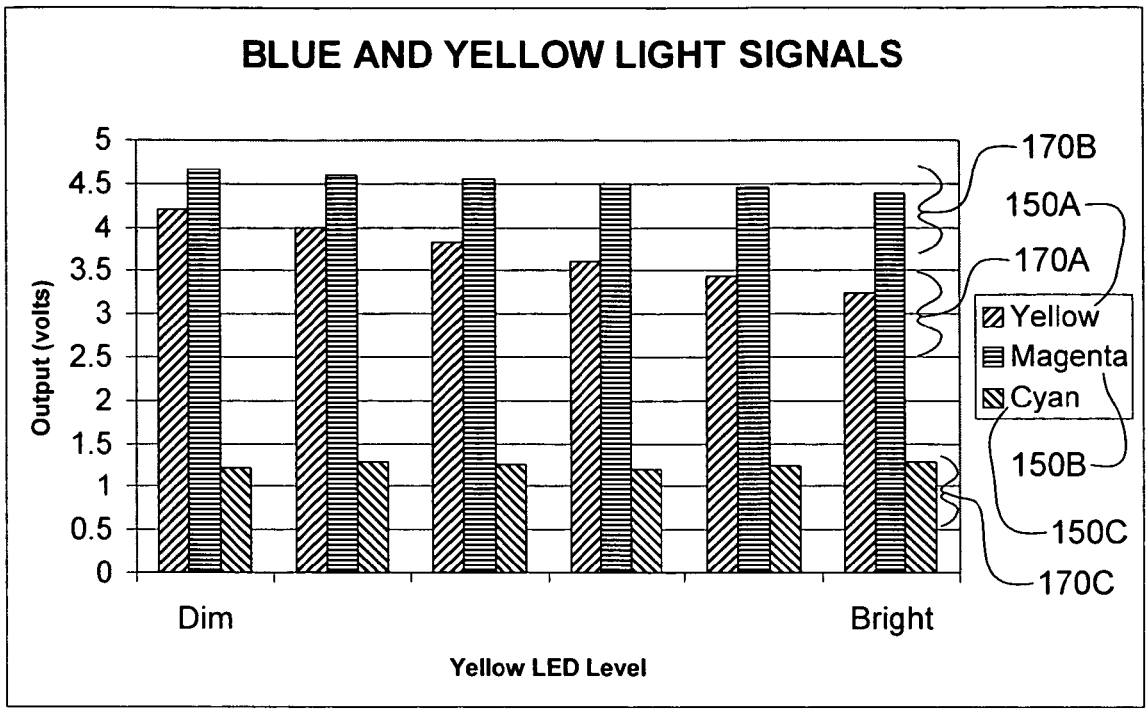
FIG. 5 is a chart illustrating the behavior of an output signal from the ribbon sensor of the present invention in response to the reception of blue and yellow light signals through different colored ribbon panels while the intensity of the blue light signal is held constant and the intensity of the yellow light signal is varied.

In accordance with one embodiment of the invention, the output signal 164 is analyzed by signal analyzer circuitry 170 to detect the color of the subject panel 150 by measuring a voltage across a resistance through which the output signal 164 is conducted. The resultant voltage signal has a magnitude that varies in response to the intensity of the light transmitted through the ribbon 120 that is received by the receiver 158 and the color of the subject ribbon panel 150, as shown in FIG. 5. The signal analyzer utilizes voltage threshold detectors, comparators, etc. to determine where the output signal 158 lies within a predetermined voltage range, which then identifies the color of the subject panel 150, in accordance with known methods.

As discussed above, the light signals 160 and 162 are selected to have different transmissivities through each of the ribbon panels such that the intensity of light received by the receiver 158 will be indicative of the color of the subject panel 150. The yellow light signal emitted by the emitter 154 has the greatest transmissivity (i.e., substantially unblocked) through the yellow panel 150A. The yellow light signal 160 has significantly lower transmissivities (i.e., substantially blocked) through the magenta panel 150B and the cyan panel 150C. On the other hand, the blue light signal 162 produced by emitter 156 has the greatest transmissivity through the cyan panel 150C, a lower transmissivity through the yellow panel 150A, and is mostly blocked by the magenta panel 150B.

The differences in the transmissivity of the combined yellow and blue light signals 160 and 162 through the colored ribbon panels 150 allows for easy identification of the color of the panel 150 being analyzed. This is illustrated in the bar chart of FIG. 5, which shows voltages of the output signal from the receiver 158 (measured across a resistance) that are produced in response to the reception of the light signals 160 and 162 through yellow, magenta, and cyan colored panels 150A–150C. The intensity of the blue light signal 162 was held constant while the intensity of the yellow light signal 160 was adjusted from a dim setting to a bright setting. As shown in FIG. 5, the output signal 164 has three distinct modes 170A–170C that correspond to the reception by the receiver of the yellow and blue light signals 160 and 162 through the yellow, magenta, and cyan panels 150A–150C that become more distinguishable (i.e., spread apart) as the intensity of yellow light signal 160 is increased. More particularly, the readings of the yellow panels 150A become more displaced from the readings of the magenta panels 150B as the intensity of the yellow light signal 160 is increased and while the intensity of the blue light signal 162 remains constant.

The large differences between the three modes 170A–170C of the output signal 164 for the colored ribbon panels allow for more accurate ribbon panel color identification. The large spread also results in reduced sensitivity to color panel variations found between ribbon panels of different manufactures.

Figure 6:
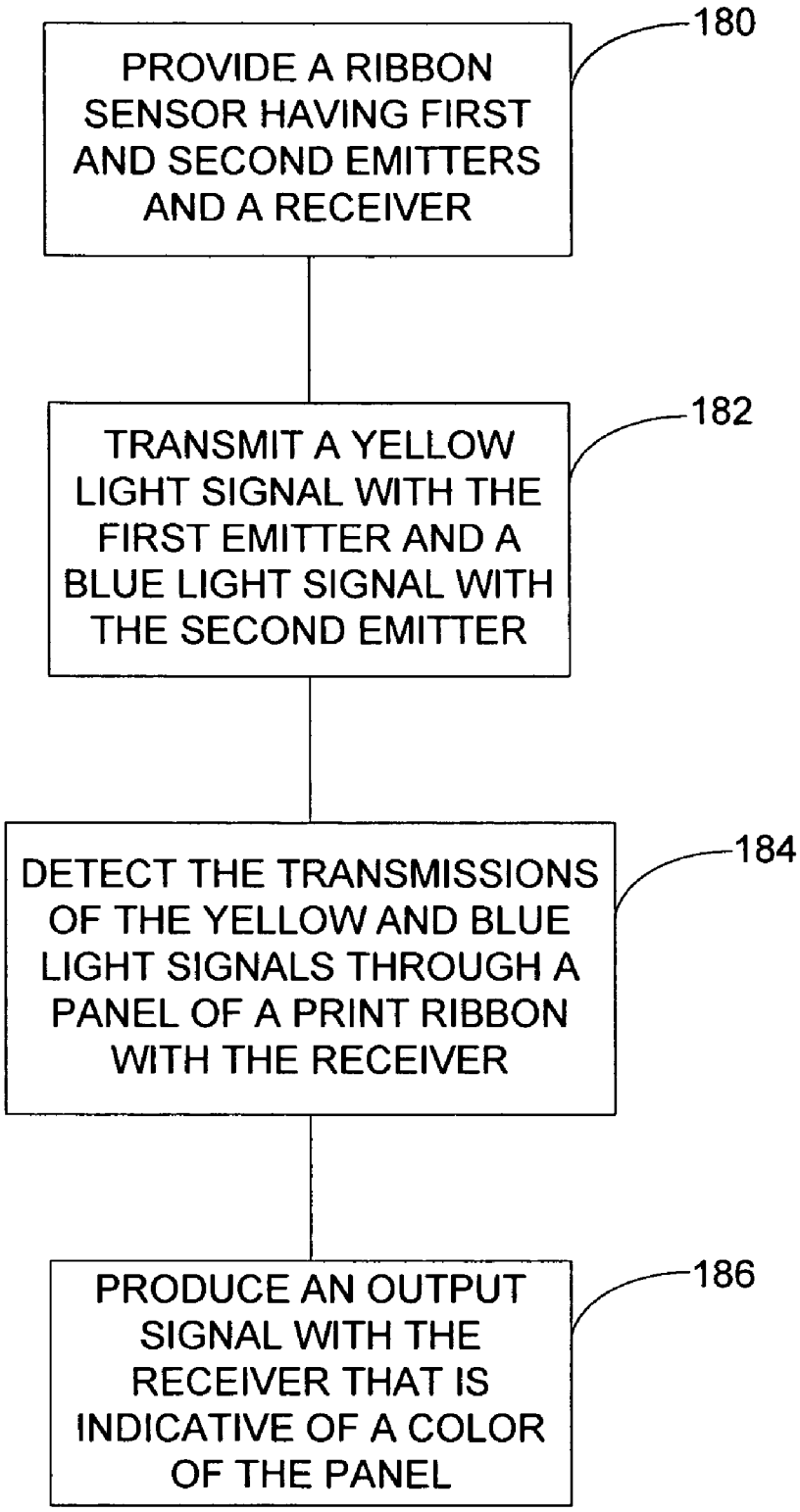
FIG. 6 is a flowchart illustrating steps of a method of identifying ribbon panel colors in accordance with embodiments of the invention.

Another aspect of the present invention is directed to a method of identifying color panels of a print ribbon utilizing the ribbon sensor 152 described above. FIG. 6 is a flowchart illustrating steps of the method, in accordance with embodiments of the invention. At step 180, a ribbon sensor, such as ribbon sensor 152 described above, is provided. The ribbon sensor includes a first emitter 154 configured to transmit a yellow light signal 160, a second emitter 156 configured to transmit a blue light signal 162, and a receiver 158. Next, at step 182, the yellow and blue light signals 160 and 162 are transmitted with the first and second emitters 154 and 156. The transmissions of the first and second light signals 160 and 162 through a panel 150 of the ribbon 120 are detected with the receiver 158, at step 184. Finally, at step 186, an output signal 164 is produced by the receiver 158 that is indicative of a color of the panel 150 in response to the detection of the first and second light signals 160 and 162. Additional embodiments of the method of the present invention include providing the sensor 152 with selected features discussed above.

Although the present invention has been described with reference to preferred embodiments, workers skilled in the art will recognize that changes may be made in form and detail without departing from the spirit and scope of the invention.

What is claimed is:

1. A ribbon sensor for use in a printer comprising:

first and second emitters respectively transmitting first and second light signals, wherein the first light signal has a different wavelength than the second light signal; and a photodetector configured to produce an output signal in response to simultaneous reception of a combination of the first and second light signals through a print ribbon panel, wherein the output signal is indicative of a color of the print ribbon panel.

2. The printer of claim 1, wherein the output signal includes at least three distinct modes, each of which is indicative of a different print ribbon panel color.

3. The sensor of claim 2, wherein the output signal includes a first mode indicative of the reception of the combination of the first and second light signals through a cyan print ribbon panel, a second mode indicative of the reception of the combination of the first and second light signals through a magenta print ribbon panel, and a third mode indicative of the reception of the combination of the first and second light signals through a yellow print ribbon panel.

4. The sensor of claim 2, wherein the first and second light signals have wavelengths between 400 nm and 700 nm.

5. The sensor of claim 4, wherein the first light signal is a yellow light signal and the second light signal is a blue light signal.

6. The sensor of claim 5, wherein the first light signal has a wavelength of approximately 587 nm and the second light signal has a wavelength of approximately 468 nm.

7. The sensor of claim 5, wherein the first emitter includes a yellow LED configured to transmit the yellow light signal, and the second emitter includes a blue LED configured to transmit the blue light signal.

8. The sensor of claim 1, wherein the first emitter adjoins the second emitter.

9. A printer comprising:

a print ribbon having a plurality of panels, each panel including a print consumable having one of a plurality of colors;

a printhead configured to transfer the print consumable from the color panels to a surface of a card; and a sensor configured to detect the color of the print consumable of each of the panels, the sensor comprising:

first and second emitters respectively transmitting first and second light signals, wherein the first light signal has a different wavelength than the second light signal; and a photodetector configured to produce an output signal in response to simultaneous reception of a combination of the first and second light signals through a print ribbon panel, wherein the output signal is indicative of a color of the print ribbon panel.

10. The printer of claim 9, wherein the output signal includes at least three distinct modes, each of which is indicative of a different print ribbon panel color.

11. The sensor of claim 10, wherein the output signal includes a first mode indicative of the reception of the combination of the first and second light signals through a cyan print ribbon panel, a second mode indicative of the reception of the combination of the first and second light signals through a magenta print ribbon panel, and a third mode indicative of the reception of the combination of the first and second light signals through a yellow print ribbon panel.

12. The printer of claim 10, wherein the first and second light signals are visible light signals having wavelengths between 400 nm and 700 nm.

13. The printer of claim 12, wherein the first light signal is a yellow light signal and the second light signal is a blue light signal.

14. The printer of claim 13, wherein the first emitter includes a yellow LED configured to transmit a yellow light signal, and the second emitter includes a blue LED configured to transmit a blue light signal.

15. A method of identifying a colors of a print ribbon panels comprising steps of:

providing a ribbon sensor comprising a first emitter, a second emitter, and a photodetector;

simultaneously transmitting a first light signal using the first emitter and a second light signal using the second emitter;

detecting a combination of the simultaneous transmissions of the first and second light signals through a print ribbon panel with the photodetector; and producing an output signal with the photodetector that is indicative of a color of the print ribbon panel in response to the detecting step.

16. The method of claim 15, wherein the output signal includes at least three distinct modes, each of which is indicative of a different print ribbon panel color.

17. The method of claim 15, wherein:

the producing step includes producing a first mode of the output signal when the color of the print ribbon panel is cyan, producing a second mode of the output signal when the color of the print ribbon panel is magenta, and producing a third mode of the output signal when the color of the print ribbon panel is yellow; and the first, second and third modes of the output signal are distinct.

18. The method of claim 17, wherein the first and second light signals have wavelengths between 400 nm and 700 nm.

19. The method of claim 18 wherein the first light signal is a yellow light signal having a wavelength of approximately 587 nm and the second light signal is a blue light signal having a wavelength of approximately 468 nm.

20. The method of claim 19, wherein the first emitter includes a yellow LED configured to transmit a yellow light signal, and the second emitter includes a blue LED configured to transmit a blue light signal.

* * * * *